United States Patent [19]

Lloyd

[11] Patent Number: 4,616,408

[45] Date of Patent: Oct. 14, 1986

[54] INVERSELY PROCESSED RESISTANCE HEATER

[75] Inventor: William J. Lloyd, Belmont, Calif.

[73] Assignee: Hewlett-Packard Company, Palo Alto, Calif.

[21] Appl. No.: 687,507

[22] Filed: Jan. 4, 1985

Related U.S. Application Data

[63] Continuation of Ser. No. 444,412, Nov. 24, 1982, abandoned.

[51] Int. Cl.[4] ..... H05B 3/00

[52] U.S. Cl. ..... 29/611; 29/846; 427/444; 427/445

[58] Field of Search ..... 29/611, 846, 847, 848; 427/101, 103, 444, 445, 289

[56] References Cited

U.S. PATENT DOCUMENTS

| | | | |
|---|---|---|---|
| 3,324,014 | 6/1967 | Modjeska | 29/848 |
| 4,169,032 | 9/1979 | Haase | 204/192 F |
| 4,194,108 | 3/1980 | Nakajima et al. | 29/611 |
| 4,241,103 | 12/1980 | Ohkubo et al. | 29/611 |
| 4,306,925 | 12/1981 | Lebow et al. | 29/848 |

FOREIGN PATENT DOCUMENTS

| | | |
|---|---|---|
| 54-85734 | 7/1979 | Japan . |
| 0015100 | 6/1980 | United Kingdom . |

*Primary Examiner*—Howard N. Goldberg
*Assistant Examiner*—P. W. Echols
*Attorney, Agent, or Firm*—Jeffery B. Fromm

[57] ABSTRACT

A unique inverse processed film resistance heater structure is disclosed. A conventional passivation wear layer is deposited directly on a first substrate, followed by the deposition and patterning of resistive and conductive layers, and covered by an isolation layer and a thick support layer. The thick support layer is then bonded to a second substrate and the first substrate is removed so that a uniform, flat passivation layer is exposed. The result is a film resistor which has a reduced failure rate as compared to the prior art because it is covered by a passivation wear layer with fewer pin-holes and reduced stress.

10 Claims, 3 Drawing Figures

INVERSELY PROCESSED RESISTANCE HEATER

This is a continuation of application Ser. No. 444,412, filed 11-24-82, now abandoned.

BACKGROUND OF THE INVENTION

1. Cross Reference to Related Application

Thermal ink jet resistors and direct writing thermal print heads have conventionally been fabricated by means of standard thick and thin film resistor deposition techniques. In one example of this technique as shown in FIG. 1 a thin layer of resistor material 10, such as 500 angstroms of tantalum/aluminum alloy is deposited on an isolation layer 15 such as silicon dioxide overlaying a silicon substrate 20. The isolation layer 15 provides the necessary electrical and thermal insulation between the resistive layer 10 and the silicon substrate 20. A conductive layer 30 such as 1 micron of aluminum is deposited on top of the resistance layer 10, and the conductive layer 30 and resistance layer 10 are patterned forming a resistor 40 connected by conductors 50. Finally, a passivation wear layer 60, for example 2–3 microns of silicon dioxide or silicon carbide, is deposited over the entire structure. The resistor 40 is then used to heat the ink or thermal paper which is just above the passivation layer 60.

In such film resistor devices, failures often occur in regions where there is a step height change in the surface profile such as region 70 in FIG. 1, which result from patterning the resistance layer 10 and conductive layer 30. Stress in the passivation wear layer 60 is highest in the step regions 70, and the occurrence of pinholes is greatest along these steps.

It is possible to reduce the stress and pin-holes in the passivation layer 60 by making the passivation layer 60 thicker, but this is usually undesirable since it increases the thermal isolation of the resistor 40 from the ink or paper, thereby reducing heat transfer from the resistor 40 to the ink or paper and causing higher resistor temperatures which can induce further failures.

2. Summary of the Invention

Height changes in the passivation wear layer between the film resistor and the ink in a thermal ink jet printer or the thermal paper in a direct writing print head can be eliminated by fabricating the device in reverse order as compared to conventional film resistors and then etching away the underlying substrate. The result is an inverse fabricated resistor with reduced failures due to stress or pin-holes in the passivation layer.

A passivation film such as 1–2 microns of silicon dioxide or silicon carbide is deposited directly on a first substrate such as silicon or glass to form a flat, smooth passivation wear layer. This is followed by deposition and subsequent patterning of resistive and conductive layers, for example made of 500 angstroms of tantalum-/aluminum and 1 micron of aluminum respectively. A thermal isolation layer such as 2–3 microns of silicon dioxide is then deposited over the resistor and conductor pattern, followed by a thick layer (10–1000 microns) of a metal such as nickel or copper, which serves as both a heat sink and support layer. The thick metal layer may then be bonded to a support bearing substrate and the first substrate is removed for example by etching.

The result is a film resistor overlain with a uniform, thin passivation wear layer which can be used to produce localized heating as needed in a thermal ink jet printer or in a contact thermal printing head with increased reliability over the prior art.

DETAILED DESCRIPTION OF THE INVENTION

Figure 2:
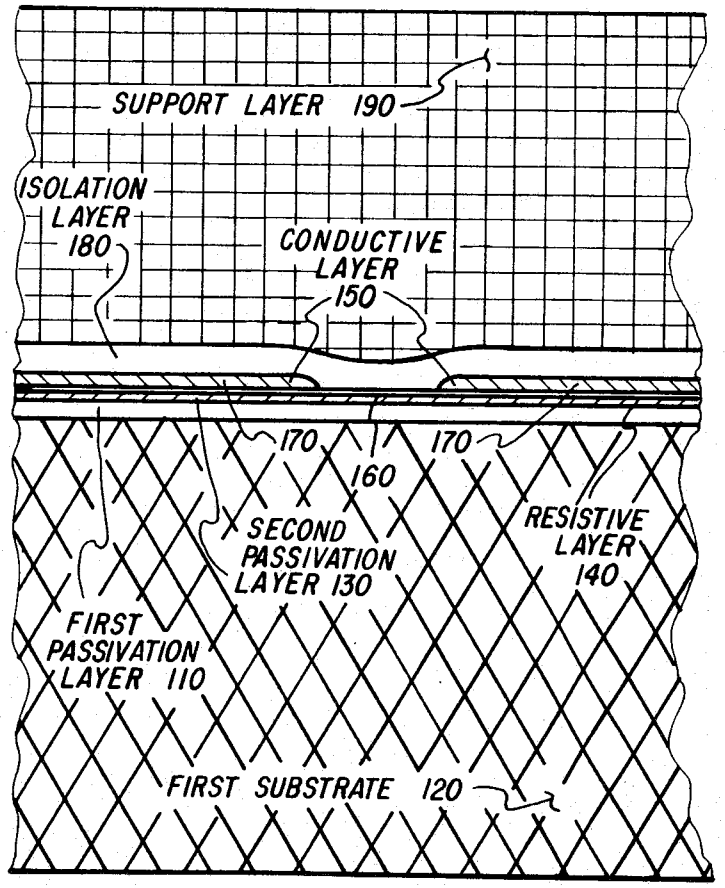
FIG. 2 shows a preferred embodiment of an intermediate thermal heater structure according to the present invention.
Figure 1:
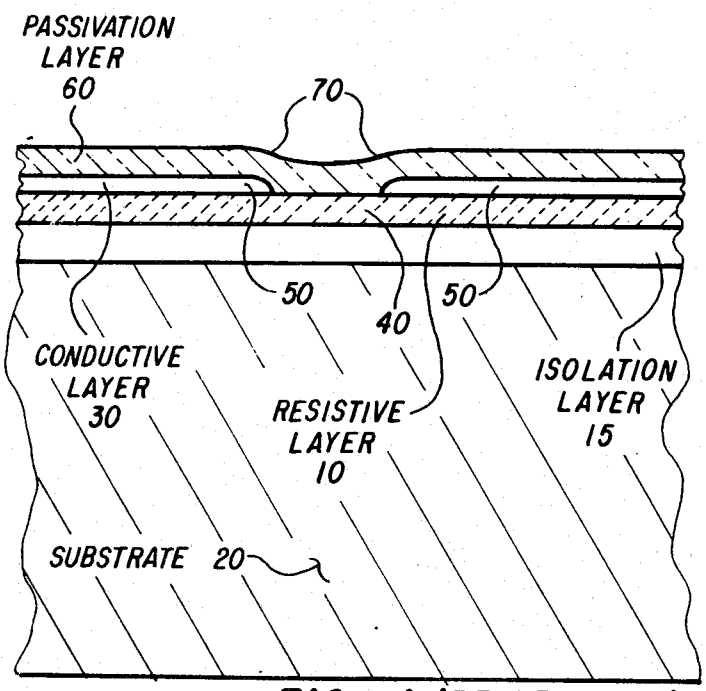
FIG. 1 (PRIOR ART)
FIG. 1 shows a conventional thermal heater structure according to the prior art.

FIG. 2 shows an intermediate thermal heater structure according to a preferred embodiment of the present invention. A first passivation layer 110 for example of 1–2 microns of silicon carbide is deposited on a first substrate 120 such as a 0.5 mm thick silicon wafer. The first substrate 120 can also be made of glass or other etchable materials which are smooth and flat. A second passivation layer 130 for example 0.2–0.5 microns of silicon dioxide is then deposited on top of the first passivation layer 110. In alternative embodiments, the first passivation layer 110 and second passivation layer 130 may be made of other suitable passivation materials or combined as a single passivation layer made from silicon carbide, silicon dioxide or other suitable passivation materials that are well known in the art. In either case, the result is a passivation layer which is flat and smooth with very few pin-holes.

A resistive layer 140, such as 500 angstroms of tantalum/aluminum, and a conductive layer 150, such as 1.0 micron of aluminum, are deposited on the passivation layers 110 and 130 then patterned forming resistor 160 and conductors 170. In FIG. 2 the conductive layer 150 is on top of the resistive layer 140, but the order of these layers can also be reversed.

An isolation layer 180 such as 2–3 microns of silicon dioxide is then deposited on the patterned resistor 160 and conductors 170. Then a support layer 190 of a film such as 100–200 microns of nickel or copper is deposited on the isolation layer 180. The support layer 190 can be fabricated for example by sputtering or evaporating a thin coat of metal film followed by electroplating of the necessary relatively thick support layer 190. The support layer 190 forms a good heat sink and support layer during subsequent processing and use. The isolation layer 180 thus serves to provide thermal and electrical insulation between the resistor 160 and the support layer 190.

Figure 3:
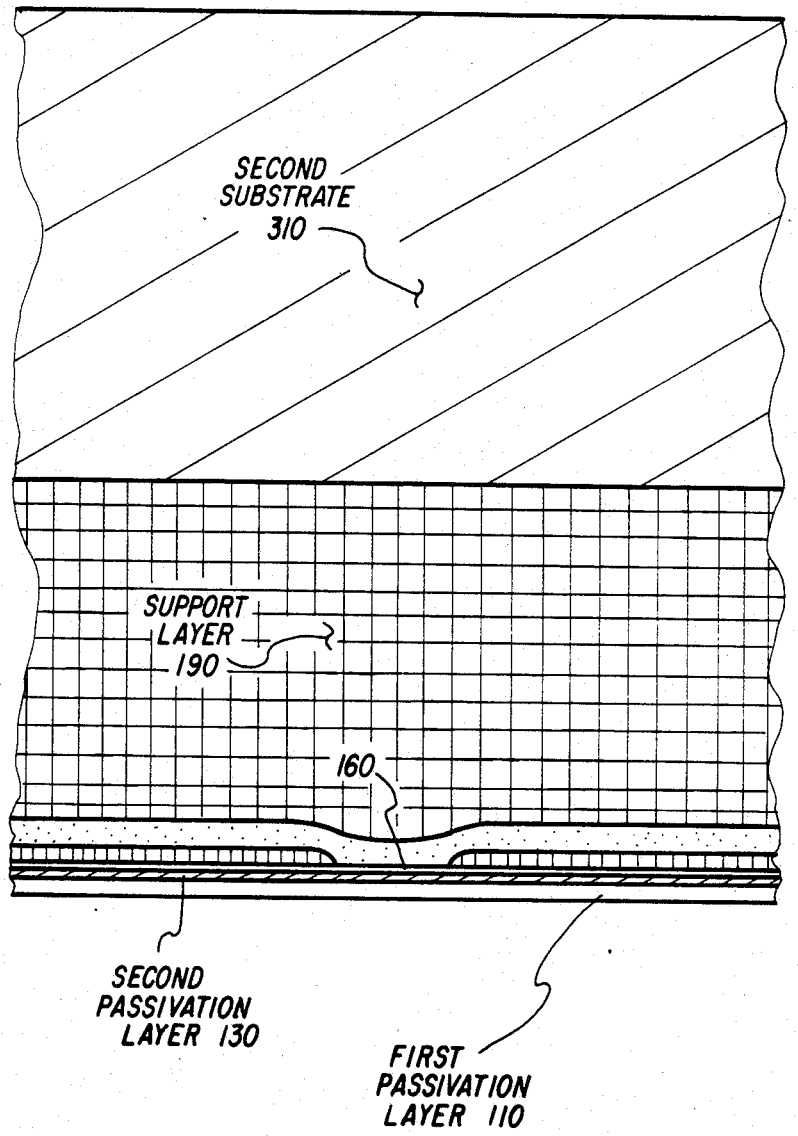
FIG. 3 shows a preferred embodiment of the final thermal heater structure according to the present invention.

As shown in FIG. 3, the support layer 190 of the intermediate structure of FIG. 2 is then bonded to a second substrate 310. Finally, the first substrate 120 of FIG. 2 is removed by an appropriate process such as etching to reveal the resistor 160 completely covered by the uniform and flat passivation layers 110 and 130. In alternative embodiments, the isolation layer 180 and support layer 190 can be made sufficiently thick so as to eliminate the need of the second substrate 310, or the first substrate 120 may be removed before the application of the second substrate 310.

As would be apparent to one skilled in the art, the previously described invention is not only suitable for the production of resistors in thermal ink jet printers and direct writing thermal print heads, but also various other uses for power film resistors which are subjected to high temperatures and high mechanical stress.

I claim:

1. A method of fabricating a resistance heater on a first substrate, comprising in order the steps of:

(1) depositing a first electrically non-conductive, uniformly thick passivation wear layer on the first substrate;

(2) permanently depositing a resistor connected to a plurality of conductors on the first passivation layer;

(3) depositing a support layer; and (4) removing the first substrate while leaving said first passivation layer to protect the resistor from externally applied stress and thereby exposing an outer surface of the first uniformly thick passivation layer overlaying the resistor, said outer surface being substantially flat.

2. A method as in claim 1 further comprising between steps (1) and (2) depositing a second passivation layer.

3. A method as in claim 1 further comprising between steps (2) and (3) depositing an isolation layer.

4. A method as in claim 1 further comprising between steps (3) and (4) bonding a second substrate to the support layer.

5. A method as in claim 1 further comprising after step (4) bonding a second substrate to the support layer.

6. A method of fabricating a resistance heater on a first substrate, comprising in order the steps of:

(1) depositing a first electrically non-conductive, uniformly thick passivation wear layer on the first substrate;

(2) permanently depositing a resistive and conductive layer on the first passivation layer;

(3) patterning the resistive and conductive layer to form a resistor connected to a plurality of conductors;

(4) depositing a support layer; and (5) removing the first substrate while leaving said first passivation layer to protect the resistor from externally applied stress and thereby exposing an outer surface of the first uniformly thick passivation layer overlaying the resistor, said outer surface being substantially flat.

7. A method as in claim 6 further comprising between steps (1) and (2) depositing a second passivation layer.

8. A method as in claim 6 further comprising between steps (3) and (4) depositing an isolation layer.

9. A method as in claim 6 further comprising between steps (4) and (5) bonding a second substrate to the support layer.

10. A method as in claim 6 further comprising after step (5) bonding a second substrate to the support layer.

* * * * *